United States Patent [19]

March

[11] 4,389,958

[45] Jun. 28, 1983

[54] HULL FOR MULTIHULLED SAILING VESSELS

[76] Inventor: Rodney C. March, P.O. 57 The Leas, Minister, Isle of Sheppey, Kent, England

[21] Appl. No.: 136,480

[22] Filed: Apr. 2, 1980

Related U.S. Application Data

[63] Continuation-in-part of Ser. No. 13,692, Feb. 21, 1979, abandoned, which is a continuation of Ser. No. 862,547, Dec. 20, 1977, abandoned, which is a continuation of Ser. No. 719,517, Sep. 1, 1976, abandoned.

[30] Foreign Application Priority Data

Sep. 3, 1975 [GB] United Kingdom ..... 36236/75

[51] Int. Cl.[3] ..... B63B 3/00

[52] U.S. Cl. ..... 114/39; 114/56; 114/61

[58] Field of Search ..... 114/39, 61, 56, 271, 114/291, 292

[56] References Cited

U.S. PATENT DOCUMENTS

| | | | |
|---|---|---|---|
| 652,876 | 7/1900 | Andrade, Jr. | 114/56 |
| 806,223 | 12/1905 | Wheles | 114/56 |
| 2,700,357 | 1/1955 | Winter | 9/6 W |
| 3,168,425 | 2/1965 | Wiplinger | 114/292 X |
| 3,814,835 | 6/1974 | Merry | 114/90 |
| 3,865,061 | 2/1975 | Newman | 114/39 |

FOREIGN PATENT DOCUMENTS

| | | | |
|---|---|---|---|
| 665129 | 6/1964 | Italy | 114/61 |

*Primary Examiner*—Sherman D. Basinger
*Attorney, Agent, or Firm*—Fidelman, Wolffe & Waldron

[57] ABSTRACT

Multihulled sailing vessels are provided wherein at least one hull, and preferably all hulls, are so shaped that there is a discontinuity in the keel line abaft the midship station of the hull, the rate of change of depth of the hull from bow to stern being different immediately abaft the discontinuity toward the stern.

8 Claims, 14 Drawing Figures

HULL FOR MULTIHULLED SAILING VESSELS

CROSS-REFERENCE TO RELATED APPLICATIONS

This application is a continuation in part application of Ser. No. 013,692, filed Feb. 21, 1979, which is a continuation of application Ser. No. 862,547, filed Dec. 20, 1977, which is a continuation of application Ser. No. 719,517, filed Sept. 1, 1976, all now abandoned.

BACKGROUND OF THE INVENTION

The present invention relates to a novel form of hull for multihulled sailing vessels, including catamarans, trimarans, proas, and the like.

The performance of vessels on the surface of water is determined by a complex relationship of a relatively large number of parameters. The interdependence of all the relevant parameters is reasonably quantifiable for engine driven vessels, but in the case of sailing vessels, the number of parameters is greatly increased owing to the dominant role of the wind on performance, a factor of minimal, even trivial, significance for power driven vessels and one which is ordinarily ignored from most aspects. As a consequence of the greatly amplified complexity, the design of sailing vessels is dominantly empirical and retains much of the character of an art even in the present scientific era. Quantification of the design of sailing vessels is possible today only in certain limited fashions, and a complete objective understanding of the performance of sailing vessels remains unrealized.

Among the major factors accounting for the significant differences in the state of the design art for motor vessels as contrasted with sailing vessels are the facts that power driven vessels are designed for a single optimum speed while the speed of sailing vessels varies considerably with wind strength and other parameters and the design must accommodate reasonable levels of efficiency at these widely varying speeds. Another factor of considerable import is that when sailing at angles to the wind, considerable side (lateral) forces are involved. Under power the wind forces involved are reduced in magnitude and relative importance to the extent they can be substantially ignored, while under sail these forces are primary determinants of performance. The coupling of the hydrodynamics with the aerodynamics of the system defined by a sailing vessel greatly exceeds in complexity and uncertainty the system defined by an engine driven vessel.

Sailing directly into the wind is not a theoretical impossibility, at least given the present state of theory, but as a practical matter, such a feat is unknown for sailing vessels. Thus, in the reality of sailing vessels, a course dead down wind is the only point of sail at which side (lateral) forces have no influence on performance. For aerodynamic reasons, direct down wind sailing is avoided in the majority of conditions in which sailing vessels operate. At all other points of sail, and for the majority of the time a vessel spends under sail, side forces play a direct role in performance, increasing in relative importance from zero on the infrequent direct course to leeward to a maximum in the close hauled point of sail, i.e., at the angle relative to the wind at which velocity made good to windward ($V_{mg}$) is near maximum for the specific sailing vessel. When sailing to windward, the course of the vessel will generally maximize $V_{mg}$ at angles to the true wind direction ($\lambda$) of as low as 55 to 60 degrees, or even more for square rigged vessels and other low efficiency vessels to as high (near the wind) as about 40 degrees for modern, high efficiency vessels. The angle of incidence of the apparent wind, which is the resultant of the true wind vector with the vessel's motion vector, will be correspondingly less. A vector diagram of these velocities is shown in FIG. 10, where $V_t$ represents the speed and direction of the true wind; $V_s$ shows the course and speed of the vessel; $V_a$ shows the resultant speed and direction of the apparent wind, i.e., the wind as perceived by those onboard the vessel and as operating upon the sails; $V_{mg}$ shows speed and direction made good to windward and $\lambda$ represents the angle of the vessel's heading relative to the direction of the true wind.

Since the wind and sea are dynamic in nature, any vector diagram such as FIG. 10 is a transitory definition of state, or alternatively, an averaging of the dynamics of the phenomena involved. The wind undergoes variations in speed and direction, and the incidence of waves is considerably variable in amplitude and direction as well. A steady state equilibrium susceptible to analysis as a static system is not truly applicable, but constitutes a necessary assumption to permit rational analysis.

The effects of both wind and water on a sailing vessel can be identified for comparable assumptions, based on averaging dynamic variables, to define the vector diagram of FIG. 11, showing the forces operating on the vessel. It should be noted that the forces are not different for multihulled and monohull vessels, and for clarity in the diagram of FIG. 11, a stylized representation of a sailing vessel is shown in simple monohull form.

The difference shown in FIG. 11 between heading ($\lambda$), along the vessel centerline, and course, the actual direction of travel, defines an angle of leeway which may range from as little as one degree to as much as six or eight degrees in adverse circumstance. Typical leeway angles are ordinarily in the range of two to four degrees. It is the occurrence of leeway which makes an appreciable difference between engine driven craft and sailing vessels, as vessels under power have appreciably less leeway under normal conditions of operation, with the consequent result that drag attributable to passage of the engine driven vessel is along the center line without any significant offset to the centerline to alter the effective angle of attack of the hull relative to the water. The offset angle of attack characteristic of leeway is both the source of lateral lift of the hull, i.e., the side force necessary to counterbalance the side force of the wind upon the sails, rig, and hull, and a major source of resistance which the sailing vessel must overcome in passing through the water.

Resistance under sail includes five major components, including frictional resistance, wave-making resistance, induced drag, eddy-making resistance, and air resistance. Total resistance, the speed limiting factor in the performance of all vessels, is a complex variable which does not vary with uniformity. At low speeds, resistance increases in proportion to the square of the speed. At a certain stage, resistance passes through a regime where it increases with the fourth power of the speed, and then the rate of increase declines until it is again proportional to the square of the speed. The speeds at which these parameters occur are not absolute, but rather are dependent upon the length of the vessel, and vary in proportion to the square root of the effective sailing length of the vessel.

It is customary to relate the performance of vessels in relative terms, by dividing speed (in knots) by the square root of length (in feet) to define a speed-length ratio. To simplify comparisons, the length is chosen to be the length on the design waterline for all vessels, despite the fact that the effective sailing length may vary from design waterline length by considerable amounts in some cases, and not at all in others.

For sailing vessels, considerable proportions of time under weigh are spent at speed-length ratios of 0.8 and less. At such speeds, resistance increases with the square of the speed. At speed-length ratios of about 1 to about 1.5, resistance increases with the fourth power of speed. Above speed-length ratios of about 2, resistance again increases with the square of speed. Very few sailing vessels operate at speed-length ratios greater than about 1.5 to 1.7, as the majority of sailing vessels are not able to controllably extract sufficient energy from the wind force to effectively overcome the rapidly increased resistance in this speed-length regime. Light displacement, unballasted vessels, such as monohull dinghies and multihulled vessels do attain performance at speed-length ratios up to about 2.5, and in exceptional cases even higher. Ballasted vessels may momentarily attain speeds in such a range under exceptionally favorable conditions, but such effects are not a sustained performance parameter of such vessels, and in such speed-length ratios dynamic instabilities may occur which render the vessel uncontrollable, or nearly so. Thus, the very light displacement multihulled vessels which are the subject of the present invention and small monohull dinghies (which are not a part of the invention) are the only vessels capable of sustained performance under sail at high speed-length ratios, and the excitement of such performance represents a major attraction for such vessels.

It is apparent, then, that resistance is of considerable importance to all vessels, and particularly to sailing vessels. When high speed performance under sail is of dominant importance to a design, careful and detailed attention to the nature of resistance is appropriate.

Surface friction is the most dominant component of resistance, occurring over the entire range of speeds at which sailing vessels operate. As a source of resistance, surface friction may be considered to be the result of shear forces upon the water occasioned by the passage of the hull, defining a body of water set in motion to varying degrees. As in all fluid dynamic systems, flow of water over the hull may occur as either laminar flow or as turbulent flow, and as in most systems laminar flow results in materially less drag or resistance. Laminar flow is not, however, predictably attainable in sailing vessels and is ordinarily considered a minor factor. Thus, for all practical purposes, it is sufficient to note that frictional resistance is dependent upon surface area, length of surface, roughness of surface, and speed. As a design parameter, wetted surface is the only directly controllable factor, and with a given design concept, only a limited degree of control is possible without excessive compromise of other design parameters. Nonetheless, a design will benefit from whatever reduction of wetted surface is practicably attainable. The attainment of relative high speed in the regime where surface friction is dominant requires great sail area in relation to wetted surface.

When a vessel is in motion through water, it creates a wave system about itself as a consequence of dynamic variations in pressure beneath the surface of the water. Hydrodynamic theory has been developed to calculate the resistance attributable to wave-making in certain limited circumstances, but even for power driven vessels operating in smooth water the method is not generally applicable and no meaningful quantification is possible for sailing vessels. It is possible to say, however, that it increases from a very minor component of resistance at low speeds to a maximum at speed-length ratios of about 1.3 to 1.6, thereafter remaining relatively constant or declining somewhat. This phenomenon is quantitatively related to the fact that waves travel, as do vessels, at a speed which is related to the square root of their length, crest to crest, and at a speed-length ratio of about 1.3 to 1.4 a vessel will create a transverse wave system moving at the same speed as the vessel, where the bow of the vessel is at one crest and the stern at the next crest, so that the vessel is traveling on one single wave length. At this stage, input of additional energy to drive the vessel will result, in effect, in the vessel beginning to climb the forward wave crest, and the major effect will be dissipation of the greater part of the input to increasing wave system depth with only a very minor increase in speed.

Attempts by the vessel to pull away from the wave crest at its stern and to climb over the bow wave require dramatic increases in input energy, and it is in this condition that resistance increases as the fourth power of speed. Only the most efficient vessels can transcend the barrier defined by high wave making resistance under sail, and considerable sail area in relation to length is required.

The magnitude of the resistance attributable to wave-making is greatly dependent upon hull form and displacement; these factors dominate the depth of the wave system. The energy absorbed by wave-making varies as the fourth power of wave height. The major parameters of hull form which determine depth of the wave system are hull depth, immersed beam, and steepness of buttocks in the afterbody of the vessel. For a given vessel length, greater hull depth and immersed beam indicate relatively greater displacement, and it is for these reasons in part that light displacement vessels, characterized by shallow hulls and narrow beam, are more readily able to harness wind energy to attain relatively higher speeds and break through the high resistance of wave making at speed-length ratios of about 1.3 to 1.6 and attain higher speeds. Such considerations also dictate considerable sail area in relation to displacement.

Eddy-making as a component of resistance is attributable to the extreme turbulence resulting when flow separation occurs. Flow separation results from abrupt changes in flow caused by unfair water flow lines. Bumps, edges, protuberances, corners, hollows and like departures from fair easy curves in hull form will contribute to eddy-making, as will propellers, propeller apertures, through-hull fittings, speedometer projections, and the like. Surface roughness may also generate eddies when pronounced, in addition to increasing frictional drag. All such features should be minimized to the degree possible.

Air resistance attributable to the hull can in some designs be considerable, in addition to the aerodynamic drag of the rig and sails which of course generate aerodynamic lift as well. Since the drag component attributable to the expanse of hull exposed to wind flow does not contribute any benefit to performance, it should be minimized if possible without compromise of other design parameters. Air resistance is of relatively great significance to total resistance only in light air and low speed conditions, or in a very hard breeze.

Induced drag is the increase in resistance attributable to heel and leeway of a vessel. Because of the difference in height of the lateral forces of wind and water, a couple is formed which causes a sailing vessel to rotate about its transverse axis to an angle of heel or roll at which the couple is balanced by buoyant and gravimetric forces generated by the hull and other components. In the heeled condition, a sailing vessel will present to the water an immersed shape which will ordinarily differ to some degree from the upright immersed shape, and in most cases increasing drag or resistance. For multihulled sailing vessels, the possibility exists, and is actively sought, to operate at an angle of heel such that the windward hull is just lifted from the surface of the water, eliminating all hydrodynamic resistance attributable to the windward hull and thereby appreciably increasing speed. "Flying a hull", as such operation is known, is usual to trimarans for one hull where such a condition is normally attainable as a design parameter. In catamarans, such operation is realized only when lateral aerodynamic forces are sufficiently great to produce the requisite angle of heel. In either case, the hydrodynamic lateral force required to oppose the aerodynamic force component must be borne by the immersed hulls, and under such conditions "flying a hull" may predictably result in an increase in leeway or yaw.

The leeway component of resistance, induced drag, results from the obliquity of the angle at which the vessel travels through the water. Some leeway is necessary to sailing vessels in order to generate hydrodynamic lift to oppose the aerodynamic lift component of the sail plan, a fundamental necessity in order to sail in any direction other than directly to leeward. Lift does not occur without drag, however, and induced drag attributable to such sources may represent a considerable component as the yaw angle increases, as shown in FIG. 12, where $\delta$ is the yaw angle, $C_o$ is total resistance at a zero yaw angle, and $C_\delta$ is total resistance at yaw angle $\delta$. The relationship shown in FIG. 12 will remain approximately constant for substantially all vessels at speed-length ratios of about 0.67 to about 1.34, and at angles of heel from zero to the point at which immersion of the lee rail occurs.

It is readily apparent that the generation of adequate hydrodynamic lift at minimal angles of leeway is a design criterion of considerable import, and where the attainment of high performance is a dominant design parameter, minimizing leeway becomes of enhanced significance. The reduction of leeway or yaw has been primarily a matter of well-integrated design of hull, particularly the keel component of the hull.

In the early stages of naval architecture, lateral resistance was attributed solely to the immersed lateral plane of the vessel as hydrodynamics were not then known. Such an approach resulted in vessels which were generally slow and not weatherly. Indeed, there was a time at which sailing vessels were not able to make good any distance to weather at all, and sailing was dependent upon favorable winds to make a desired course. Such shortcomings were not solely attributable to poor hydrodynamics, as the rigs of early vessels were at least equally ill suited to windward performance, but adverse hydrodynamics played a major role.

The effect of surface area and skin friction as a component of sailing vessel performance became known through the work of British naval architect William Froude in 1875, although some basis for noting these phenomena became known as early as 1834. As a consequence, the lateral plane of sailing vessels was gradually reduced, with attendant increases in leeway and the predictable degradation of windward performance.

In 1980, the yacht Gloriana was designed and built by Nathanial Herreshoff, the first successful sailing vessel to utilize a separate, identifiable appendage keel designed to then-developing hydrodynamic principles. While Gloriana embodied a number of significant advances in addition to the revolutionary separation of the "canoe body" of the hull and the hydrofoil keel appendage, the devastating advantage of Herreshoff's perception in terms of windward performance very nearly eliminated the racing class to which the yacht was designed. The hydrofoil appendage keel was recognized, albeit gradually, to be the long hidden secret of efficiency to windward, and Gloriana marks a precisely identifiable watershed in sailing vessel design.

In the years since Gloriana, the development of hydrofoil keels and other appendages has become ever more refined and has been accepted as a leading principle of sailing vessel performance. Such practices have been extended to the point that rudders are also designed as hydrofoils, and in some vessels, no permanently fixed keel is provided at all, the hull being furnished with retractable hydrofoil appendages which may be extended for sailing to windward and retracted to reduce wetted surface when not required. Such practices are also of apparent advantage in reducing draft for operation in shoal waters.

Contemporary interest in multihulled vessels became prominent in the mid-twentieth century. Original efforts focused on development from the traditional log canoe based vessels evolved over a number of centuries by the people of Polynesia. The traditional proas and catamarans, while superior in speed and windward performance to early European monohulls, are in contemporary terms indifferent performers to windward. It was to the obvious advantage of such craft that hydrodynamic appendages, usually retractable, were added. Coupled with developments in aerodynamics, engineering, and hydrodynamic advances in hull form, multihulled vessels have developed into astoundingly fast sailing vessels; the present record for speed under sail stands at 32 knots, established by a proas of sixty feet in length, a speed-length ratio greater than 4, while a twenty foot long Tornado catamaran has been measured at a speed of twenty six knots, for a speed-length ratio greater than 5.5. Performance to windward is generally not so grand, but even so, close hauled speeds representing speed-length ratios of 2.5 are common.

For the purpose of describing the hull forms of the invention, the term "waterline" is defined as the intersection of a horizontal plane with the hull. The design waterline is the waterline located at water level according to design specifications. The term "buttock line" is the intersection of a vertical plane parallel to the centerline with the hull, and the term "transverse station shape" describes the intersection of a vertical plane perpendicular to the centerline with the hull. Finally, the term "diagonal" refers to the intersection of a non-vertical, non-horizontal plane intersecting the vertical plane through the centerline with the hull. All of these terms, waterline, buttock line, transverse section shape and diagonal, refer to the entire collection of points of intersection of the noted plane with the hull.

High performance multihulled sailing vessels are able to attain such high performance because the form lends itself to maximizing speed producing factors while minimizing resistive features. The high form stability inherent in multihulls permits the elimination of ballast, and reliance upon gravimetric stability attributable to heavy ballasting frequently employed in monohulled sailing vessels. Thus, for a given sailing length, multihulled vessels can be designed to very low displacement. Because the reduction in displacement does not result in a correlative reduction in stability, multihulls are able to employ very large sail areas in relation to displacement. Light displacement also results in permitting the development of hull lines which minimize wetted surface, which for a given length on the water line will generally be realized by employing a semicircular transverse station shape throughout the length of the wetted surface. Sail area is generally quite large in proportion to wetted surface, so that excellent light air performance is attained. Additionally, each hull can be developed with very narrow beam, a very shallow hull, and quite flat buttock lines in the after stations, both upright and heeled. Such a hull development minimizes the depth of the wave system developed on the effective sailing length, and a minimum of the energy extracted from the wind is transmitted to wave-making. The narrow beam and shallow depth of the hulls in relation to length result in very fair and gradual longitudinal lines so that flow separation is minimized and eddy formation is largely avoided.

In order to control leeway, such multihulled vessels ordinarily employ retractable centerboards or dagger boards. In catamarans it is common to provide a board in each hull, and to employ under weigh only the board in the leeward hull. This makes possible the use of asymmetric foils of optimum lift/drag characteristics on each tack so that the required lift is attained with a minimum of induced drag.

As in any technology, optimization efforts are difficult, expensive and failure prone because safety margins are frequently compromised, and beyond the capability of many of the sailors who have interest in such sailing vessels, and beyond the quality control capability of many "mass production" boat builders. Thus, cost, reliability, and the requirements of production dictate some compromise in the design of multihulled sailing vessels for the majority of the sailors and builders. The development of multihulled sailing vessels which can be inexpensively and reliably built and which can be simplified for convenient operation and maintenance by sailors of average capability, but without excessive deterioration in performance is a considerable design challenge.

One of the greatest engineering problems in high performance sailing vessels, and particularly in multihulls, is the development of practical and reliable retractable hydrodynamic appendages. Centerboards and daggerboards present numerous sources of expense and difficulty. They are relatively fragile and are subject to breakage or damage from over-stressing, from grounding, or by hitting underwater objects. They are susceptible to jamming in the wells into which they retract, and the wells themselves are prone to develop leaks and to intrude upon interior accommodations in vessels which provide such features. Mechanisms which extend and retract the appendages, when used, are subject to failures and malfunctions, most frequently at the worst possible time, of course. Permanently attached fins would minimize such problems, but lack the ability to reduce wetted surface when hydrodynamic lift is not required. Deep draft and the difficulty of handling the vessel ashore, and the ability to store and transport it upon a trailer in particular, would be compromised by fixed appendages.

Attempts have been made to develop multihulled vessels without reliance upon appendages to develop hydrodynamic lift. Obviously, such an approach is to a degree retrograde in character, and has to date succeeded only to a limited degree. Nonetheless, the practical advantages of such developments have resulted in considerable popular acceptance. The approach which has thus far been dominant has been to develop hulls having deeper, V-like transverse cross-sections which aid in controlling leeway by virtue of increased lateral plane area and higher aspect ratio of the lateral plane. (The depth of the hull is measured as the perpendicular line from the plane of the water line to the keel line of the hull.) Some designs have employed asymmetric hull forms to further improve hydrodynamic lift. As would be expected, such hull forms have resulted in relatively great degradation in performance capabilities, attributable to increased wetted surface, increasing frictional resistance, increased hull depth and, usually, very steep rise in the after buttocks, thereby increasing wave-making resistance, an increase in eddy formation largely attributable to the V-shape and the harsh run of the buttocks aft, and the consequent flow separation.

Additionally, such hulls have considerable proportions of the lateral plane in the extreme ends of the hulls, which produces an impediment to handling to the extent that maneuverability is impaired by the resistance of the hull to turning efforts which make such vessels difficult to tack, and in extreme conditions of very light or heavy winds and seas it may prove impossible to tack at all. Limited maneuverability also presents an obvious safety hazard through increased potential for collision with other vessels and obstructions, a hazard aggravated at the high speeds involved.

The adoption of V-shapes also results in a disposition of displacement in the hulls which is less suited to damp out pitching moments. Pitching is undesirable as it absorbs energy and thereby reduces speed, but in more extreme circumstances excessive pitching can result in burying the bow of the hull, which at high speeds can cause the vessel to "pitch-pole", i.e., capsize about the pitching axis.

In order to improve maneuverability and improve pitch damping, it has subsequently become common to modify the lateral plane by reducing hull draft in the ends of the vessel and increase hull draft in the waist, so that the keel profile is an arc of curve intersecting the water at the forward and after ends of the length waterline and proceeding in a smooth, fair, continuous curve having its greatest depth below the water about midships or slightly aft thereof, retaining the basic V-shape throughout. While the desired improvements may be gained in maneuverability, and some slight improvement in the pitching mode may result from a reduction of weight in the ends, the resistance is increased and hydrodynamic lift is reduced, so that performance is degraded even further.

It would clearly be desirable to develop a multihull sailing vessel of such hull form that performance would approach the levels of high technology, sophisticated craft with separate fin appendages and yet offer the reduced cost, simply engineered and maintained hull forms with no fins. The concept of developing a hull form with most of the advantages of both existing hull types, while at the same time eliminating most of the disadvantages of each represents a formidable challenge to the naval architect, and which represents the fundamental object of the present invention.

SUMMARY OF THE INVENTION

In more particular terms, it is an object of the present invention to provide a multihulled sailing vessel which combines a low resistance, high performance hull form with sufficient hydrodynamic lift to afford good velocity-made-good to windward when sailing close hauled without resort to hydrodynamic fins or appendages, and, still more particularly, without resort to retractable appendages.

In specific terms, the foregoing objects are attained by providing a multihulled sailing vessel wherein at least one hull, and preferably all hulls, are so shaped that there is a discontinuity in the keel line abaft the midships station of the hull such that the rate of change of depth of the hull from the bow to the stern is different immediately abaft the discontinuity from that immediately forward, and the depth of the hull decreases from the discontinuity toward the stern. The foregoing form in profile is coupled with the development of transverse station shapes which are veed throughout at least a portion of the hull forward of the discontinuity and are substantially semicircular or U-shaped aft of the discontinuity.

BRIEF DESCRIPTION OF THE DRAWINGS

In the accompanying drawings.

DETAILED DESCRIPTION OF THE INVENTION

The hull design parameters of the present invention provide hulls whose form is generally veed in cross-section forward, and semicircular or U-shaped aft, of an essentially abrupt transition which defines a discontinuity in the keel profile. It is generally preferred that the discontinuity be abaft midships. It is also generally preferred that the keel line be convex with respect to the waterline forward of the discontinuity and substantially straight or concave aft of the discontinuity.

To the extent the hull form is developed in accord with the foregoing parameters and is otherwise consistent with accepted design principles of naval architecture, a material advance in capability will be attained without resort to appendages to provide lift when sailing to windward; a developed multihulled sailing vessel with such hull form will realize performance approaching the optimum state of the art values while avoiding the disadvantages of separate hydrofoil or fin equipped models.

Figure 1:
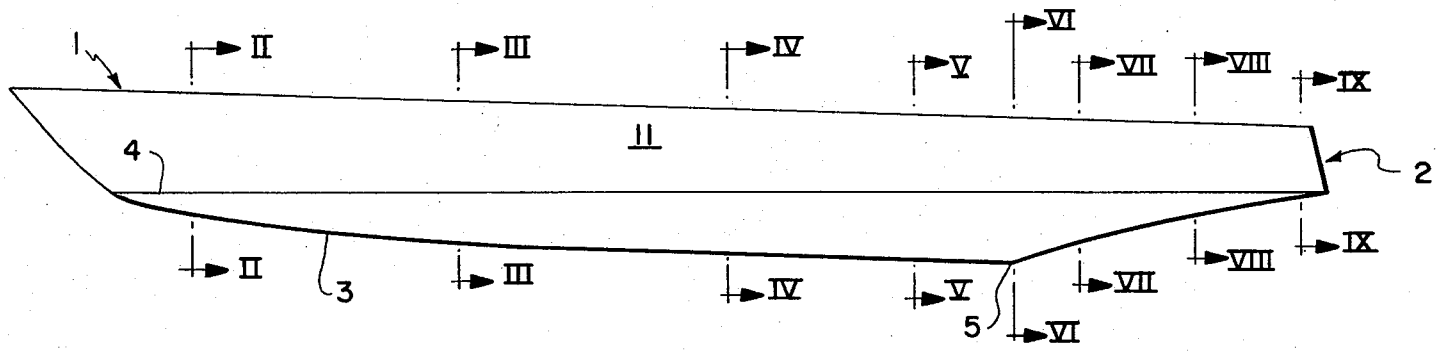
FIG. 1 shows a longitudinal vertical section through a single hull of a multi-hulled sailing vessel along the centerline or keel line of the hull.
Figure 13:
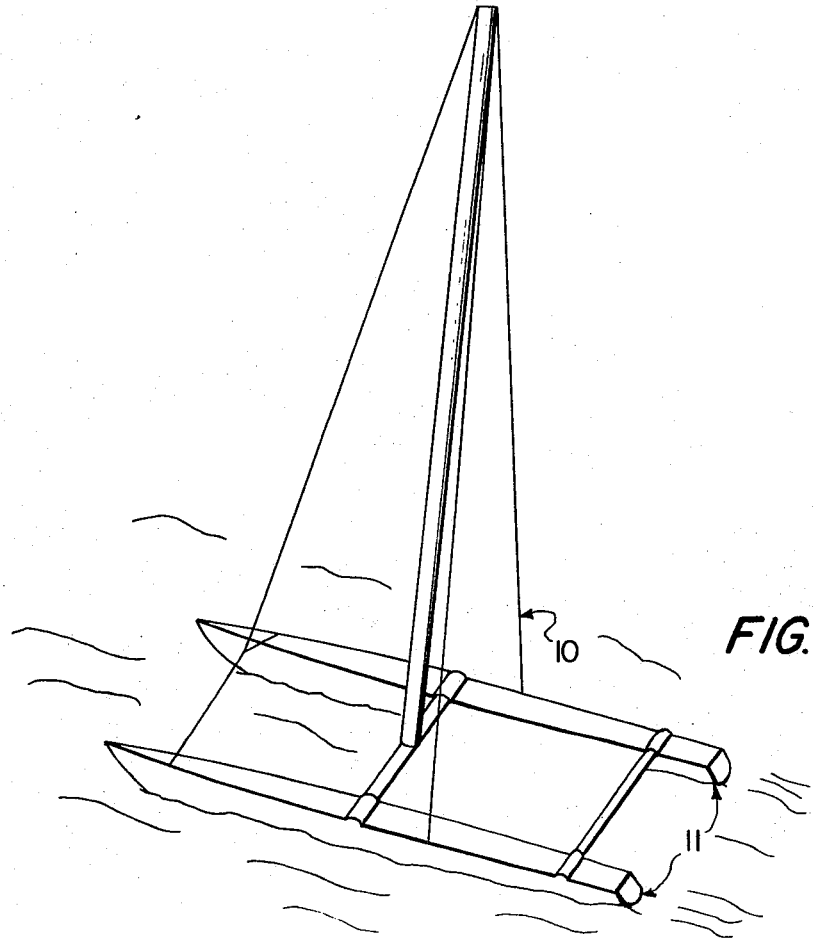
FIG. 13 is a perspective view of multihulled sailing vessel employing the hulls of the invention.
Figure 14:
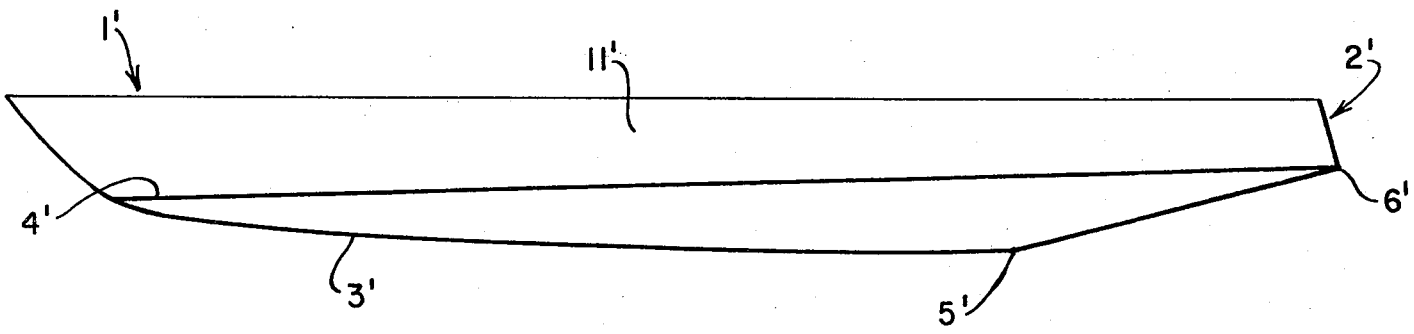
FIG. 14 shows a longitudinal vertical section through a single hull of a multi-hulled sailing vessel along the centerline or keel line of the hull, corresponding to the embodiment shown in FIG. 1 except that the keel profile from 5' to 6' is straight.

FIG. 13 presents a perspective view of a multihulled sailing vessel 10 having two hulls 11 of the invention. FIG. 1 shows further details of the hull 11 of the invention having a bow 1 and a stern 2. The keel line of the hull 11 is shown at 3 and runs from the bow end of the water line 4 to the stern end. The discontinuity 5 in the keel line 3 is substantially aft of the midship cross-section (which is approximately located at section line IV—IV). More preferably, the discontinuity is located between 0.6 and 0.875 of the design waterline length from the bow end of the keel, most preferably between 0.675 and 0.825 of that length from the bow. In practice, it is particularly preferred that the discontinuity be at a point 0.75 of the design waterline length from the bow end of the keel. Furthermore, the discontinuity is not less than 90 percent of the deepest point of draft relative to the design waterline of the hull, excluding appendages; preferably, the discontinuity is the deepest point of draft.

Figures 2, 3, 4, 5, 6, 7, 8, 9:
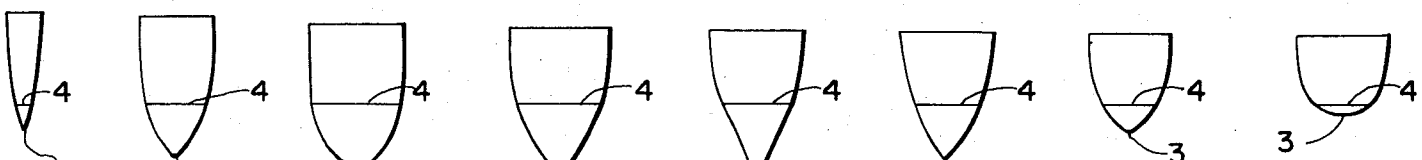
FIGS. 2–9 are transverse station views, i.e., cross-sections taken on lines II—II to IX—IX, respectively, of FIG. 1.
Figure 10:
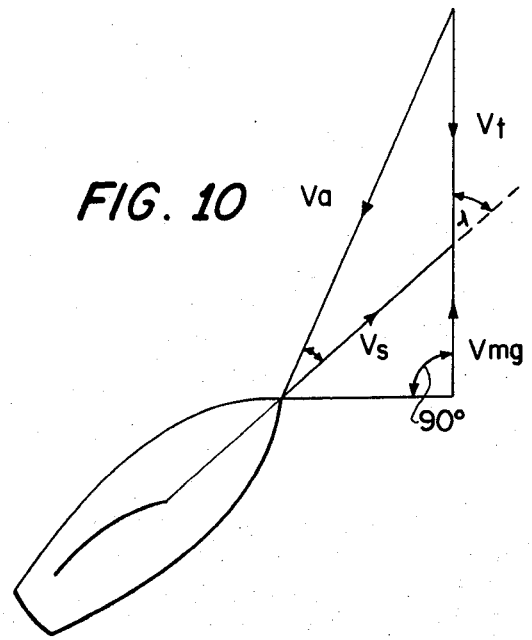
FIG. 10 is a vector diagram of the velocities of a sailing vessel shown sailing to windward.
Figure 11:
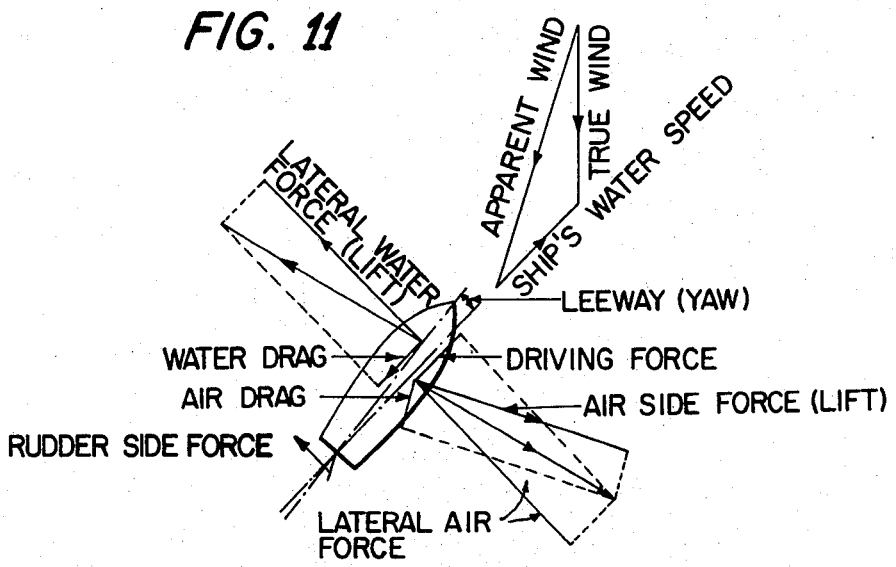
FIG. 11 is a force vector diagram of the component forces operating upon a sailing vessel when sailing to windward.
Figure 12:
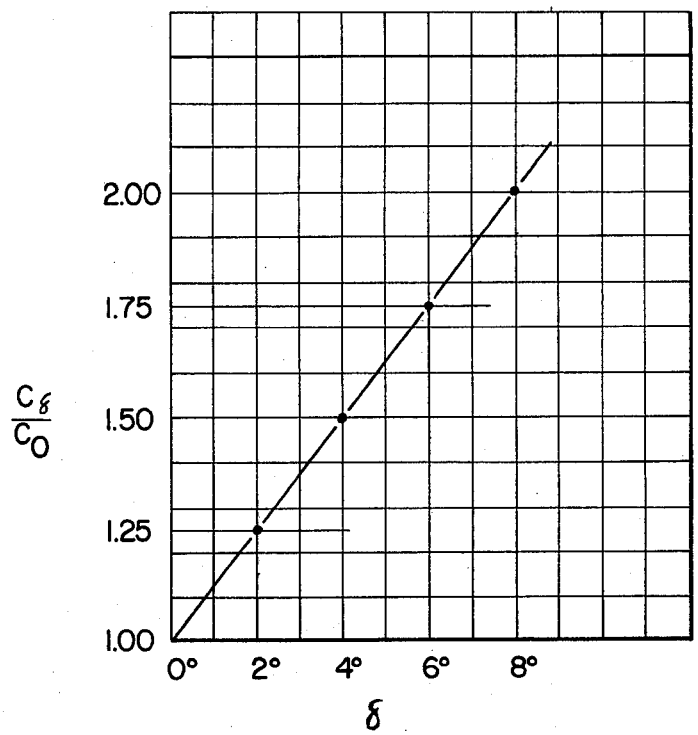
FIG. 12 is a graphic representation of the variation of induced drag with leeway (yaw angle) for a sailing vessel when sailing to windward.

As shown in FIG. 2, at the forward end of the hull, the hull in cross-section is of a pronounced V-shape; this V-shape becomes less pronounced towards the midship cross-section but preferably more pronounced thereafter until the section through discontinuity 5 (shown in FIG. 6), after which the V-shape becomes less pronounced until at the aft of the hull, the cross-section is substantially circular, or U-shaped, as shown in FIG. 9.

The sides of the hull at and about discontinuity 5 are, as shown in FIG. 6, slightly concave in transverse cross-section and gradually fill out on either side of the discontinuity so that, as shown in FIGS. 5 and 7, they are essentially straight and then, as shown in FIGS. 4 and 8 are convex.

As shown in FIG. 1, the rate of change of depth abaft the discontinuity is greater than the rate of change of depth forward of the discontinuity, since this provides a hull having greater potential speed and maneuverability.

The hulls of the invention as described above overcome the problems associated with prior art hulls while at the same time attaining superior sailing performance at widely varying speeds and directions to the wind. More specifically, vessels employing hulls of the invention are capable of performance at speed-length ratios greater than 1.5.

The hull form, as described above, has V-shaped cross-sections forward of the discontinuity which aid in controlling leeway and semicircular or U-shaped cross-sections aft of the discontinuity to aid in damping out undesirable pitching motions and decreasing the resistance of the hull to turning efforts. This combination of V-shaped and U-shaped cross-sections allows a deeper hull form with reduced wetted surface area than would be achieved if a V-shaped cross-section were maintained along the length of the hull. This gives improved performance both to windward and off the wind, and also permits excellent maneuverability, particularly when tacking. The overall design of the hulls of the invention results in sufficient hydrodynamic lift to afford good velocity-made-good without resort to hydrodynamic fins or appendages (exclusive of rudder) of any sort.

Furthermore, the design presents hull forms wherein the waterlines parallel to and below the design waterline and the diagonals of the hull below the design waterline which intersect the transverse station shape at the discontinuity at least 0.1 times the maximum beam waterline outboard of the keel line profile are smooth, fair, mathematically continuous. The buttock lines of the hull forms, like the diagonals, may similarly form smooth, fair mathematically continuous curves below said design waterline and at least 0.1 to 0.25 times the maximum beam waterline outboard from said keel line profiles. These hull forms effectively reduce eddy formation and flow separation, resulting in decreased total hull resistance.

I claim:

1. A multihulled sailing vessel, at least one hull of said vessel comprising a shallow draft hull form characterized by, A. a keel line profile configuration having a discontinuity abaft midships and wherein said keel line profile is convex relative to the design waterline from the forward intersection of said design waterline and said keel line profile to said discontinuity and wherein said keel line profile is substantially straight or concave relative to the design waterline from said discontinuity aft to the after intersection of said design waterline and said keel line profile;

B. said discontinuity being not less than 90 percent of the deepest point of draft relative to said design waterline of said hull, excluding appendages;

C. station sections forward of said discontinuity having a substantially veed form and station sections aft of said discontinuity having a substantially semicircular or U-form;

D. said hull providing sufficient lateral hydrodynamic lift to provide good windward performance without reliance upon hydrodynamic fins or appendages;

E. said hull form being adapted to generate a high hydrodynamic lift-to-drag ratio and high hydrodynamic lift when operating at leeway angles greater than zero and up to about eight degrees, and low drag when operating at leeway angles of substantially zero;

whereby said vessel is capable of performance at speed-length ratios greater than 1.5.

2. The vessel of claim 1 wherein said keel line profile is a first continuous curve from the said forward intersection aft to said discontinuity and a second continuous curve from said discontinuity aft to said after intersection.

3. The vessel of claim 1 wherein the waterlines of said hull form parallel to and below said design waterline and the diagonals of said hull form below said design waterline which intersect the transverse station shape at the discontinuity at least 0.1 times the maximum beam waterline outboard of the keel line profile are smooth, fair, mathematically continuous curves.

4. The vessel of claim 3 wherein the buttock lines of said hull form below said design waterline and at least 0.25 times the maximum beam waterline outboard from said keel line profile are smooth, fair, mathematically continuous curves.

5. The vessel of claim 3 wherein the buttock lines of said hull form below said design waterline and at least 0.1 times the maximum beam waterline outboard from said keel line profile are smooth, fair, mathematically continuous curves.

6. The vessel of claim 1 wherein said discontinuity is located at a point of from about 0.6 to 0.875 times the design waterline length aft the forward end of said design waterline.

7. The vessel of claim 1, wherein said discontinuity is located at a point from about 0.675 to 0.825 times the design waterline length aft the forward end of said design waterline.

8. The vessel of claim 1, wherein said discontinuity is located at a point 0.75 times the design waterline length aft the forward end of said design waterline.

* * * * *